US007871229B2

(12) United States Patent
Haddad et al.

(10) Patent No.: US 7,871,229 B2
(45) Date of Patent: Jan. 18, 2011

(54) TEMPORARY BULKHEAD FOR REFRIGERATION STRUCTURES

(76) Inventors: Daniel Anthony Haddad, 15 Holt St., Pittsburgh, PA (US) 15203; Joyce Christine Frieze, 15 Holt St., Pittsburgh, PA (US) 15203

( * ) Notice: Subject to any disclaimer, the term of this patent is extended or adjusted under 35 U.S.C. 154(b) by 265 days.

(21) Appl. No.: 12/287,392

(22) Filed: Oct. 10, 2008

(65) Prior Publication Data

US 2010/0089911 A1 Apr. 15, 2010

(51) Int. Cl.
*B60P 7/08* (2006.01)

(52) U.S. Cl. ..... 410/129; 410/119; 410/140; 296/24.41

(58) Field of Classification Search ..... 410/121, 410/129, 130, 140, 119; 220/531; 52/309.15, 52/630, 794.1; 296/24.35, 24.41; 160/40, 160/351

See application file for complete search history.

(56) References Cited

U.S. PATENT DOCUMENTS 4,049,311 A 9/1977 Dietrich
4,342,336 A 8/1982 Satterthwaite
4,366,977 A 1/1983 Davis
4,880,342 A * 11/1989 Pradovic ..... 410/121
5,209,498 A 5/1993 Colin
6,206,624 B1 3/2001 Brandenburg
6,305,128 B1 10/2001 Horner
6,688,821 B1 2/2004 Snyder
7,131,805 B1 11/2006 Morris

* cited by examiner

*Primary Examiner*—Stephen Gordon
(74) *Attorney, Agent, or Firm*—Theresa M. Seal

(57) ABSTRACT

A temporary, disposable bulkhead disposed within a refrigerated structure such as a refrigerated cargo trailer for separating frozen product from non-frozen product and maintaining the integrity of both types of product includes a pair of pivotally attached insulation members with each insulation member including a cavity containing a flexible, inflatable air bag and a measuring device for measuring the interior dimensions of the cargo trailer so that the bulkhead can be cut to fit the interior dimensions whereupon the air bags are inflated for sealing against the cargo trailers' sidewalls and a foam insulation strip extending along the upper side of both insulation members seals against the cargo trailer ceiling thereby creating two separate compartments within the cargo trailer that are airtight sealed from each other for maintaining the integrity and quality of the frozen and non-frozen product throughout the transport and shipping process.

18 Claims, 6 Drawing Sheets

TEMPORARY BULKHEAD FOR REFRIGERATION STRUCTURES

FIELD OF THE INVENTION

The present invention pertains to barriers for refrigerated units, trailers, and containers, and more particularly pertains to a temporary and disposable bulkhead that separates dry food product from frozen food product and maintains the integrity of both types of food product throughout their storage and transport.

BACKGROUND OF THE INVENTION

A majority of the goods used and consumed by the public are hauled and transported by truck; and as the airline and railway systems undergo changes, shakeouts, buyouts, and rapid increases in fuel and maintenance costs, the share of the nation's freight pool hauled by truck has steadily and dramatically increased. Recent statistics bear this out in so far as for the year 2005 the trucking industry hauled 68.9 per cent of the total volume of freight transported in the United States. In figures this equates to an all-time high carrying load of 10.7 billion tons with revenue of 623 billion dollars and which represents 84.3 per cent of the freight bill of the U.S.

But with costs for everything from fuel, maintenance, insurance, pay and benefits also rising, the trucking industry in particular is alert for ways to reduce or cut costs. These cost issues concern not only the trucking industry but also numerous related and ancillary industries such as processors, consignees, food manufacturers and food distributors. One of the primary ways to decrease costs in the form of damaged or deteriorated goods, and increase profitability, is to make certain that all goods—whether frozen or non-frozen—reach their destination intact and with their integrity fully maintained. While goods are sometimes commingled in that frozen goods are shipped with non-frozen goods, more often than not frozen goods are shipped in separate cargo trailers from the non-frozen goods. On the occasion when a shipper, vendor or customer wants to ship both types of goods in the same cargo trailer, it is imperative that they be kept separate within the interior compartment of that cargo trailer throughout the transport and shipping process which can be over a considerable distance and include numerous stops along the route. Moreover, as the refrigeration cooling unit is most often located toward or at the front of the cargo trailer, the frozen goods are placed towards the front and the non-frozen goods are placed toward the rear of the cargo trailer. But because the frozen goods must be kept frozen and the dry goods kept dry, some type of wall or barrier must be placed between the frozen goods and the non-frozen goods to maintain their integrity, i.e., to keep the frozen goods frozen and preventing the dry goods from being frozen in transit.

A common solution is for the shipper to give the trucker a couple of pieces of insulation material, such as Styrofoam, and a roll of masking tape with the injunction to build a barrier for himself or herself for segregating the frozen goods into one section or partition and the non-frozen goods into an adjoining partition or section. This is a process that can take up to an hour to complete and requires the trucker to estimate—"guesstimate"—the interior dimensions of the cargo trailer and then attempt to size and cut the insulation material to fit snugly within the interior compartment of the cargo trailer. More often than not a barrier is created that doesn't fit within the interior compartment or properly provide an airtight seal between the frozen goods and the non-frozen goods, and is flimsy and doesn't hold up during the long, bumpy, and jarring transit process. This results in the frozen product being thawed out and/or the non-frozen product being partially or fully frozen because an airtight seal wasn't maintained between the two sections and thus cooling air filtered into the partition for the non-frozen product. Thus, a more reliable and stable barrier or bulkhead that is inexpensive, easy to set up and install, easy to break down and dispose of, and can be easily sized and cut to fit within variously dimensioned storage structures such as the interior compartments of cargo trailers of tractor-trailers is highly desirable, and thus the prior art discloses several types of designs.

For example, the Dietrich et al. patent (U.S. Pat. No. 4,049,311) discloses a bulkhead door assembly for disposition within a refrigerated trailer but requires that tracks and support devices be mounted within the trailer for supporting the bulkhead door assembly.

The Satterthwaite et al. patent (U.S. Pat. No. 4,342,336) discloses an improved seal apparatus for insertion into and filling a correspondingly shaped hole or opening prior to the inflation of the seal apparatus.

The Davis et al. patent (U.S. Pat. No. 4,366,977) discloses a removable and movable partition that includes interconnected peripheral inflatable tube sections that are inflated against the interior walls of the cargo transporter and in so inflating tension a double flexible divider wall that extends between and separates the transporter into compartments.

The Colin patent (U.S. Pat. No. 5,209,498) discloses an inflatable sealing device for a door or moving panel that is especially applicable for use with a sliding or swing door of railway cars.

The Brandenburg patent (U.S. Pat. No. 6,206,624 B1) discloses a cargo space divider primarily for the beds of pickup trucks that includes a pair of support rails that are clamped to the upper sides of the opposed sidewalls and from which are pendent lateral and longitudinal sectioning walls.

The Snyder patent (U.S. Pat. No. 6,688,821 B1) discloses an adjustable cargo area organizer system primarily for pickup truck beds that includes a partition assembly that includes a plurality of panels that extend within the bed and longitudinal to the bed of the pickup truck.

The Morris patent (U.S. Pat. No. 7,131,805 B1) discloses an inflatable cargo cover for covering cargo in a flat bed or tractor trailer that includes an inflatable portion and an interior panel spanning between and supporting the inflatable portion.

Nonetheless, despite the ingenuity of the above devices there remains a need for a temporary and disposable bulkhead for refrigerated containers, trailers, units, and shipping structures that provides the shipper, vendor, customer, etc., with the reliability that the various products being shipped will arrive at their destination in the desired and expected condition.

SUMMARY OF THE INVENTION

The present invention comprehends a temporary, disposable, lightweight barrier or bulkhead for disposition within a refrigerated structure, such as refrigerated shipping container or unit or a refrigerated cargo container or trailer that is part of an over the road tractor-trailer unit, for separating dry items, goods, and products from frozen items, goods, and products so that the frozen product remains frozen and the non-frozen product doesn't become frozen throughout the duration of the shipping and transport process.

Thus, the present invention comprehends a lightweight, disposable bulkhead comprised of two insulation members pivotally attached to each other along a central longitudinal vertical line thereby allowing the insulation members to be folded and unfolded as needed. A flexible and continuous foam insulation strip extends along the entire upper side of the bulkhead for making an airtight seal against the ceiling of the refrigerated cargo trailer. Each insulation member includes an internal cavity, and disposed within each internal cavity is an airbag, more properly denoted an accordion pleated air bag that is capable of selective inflation and deflation via an air valve located on each bag. The air bags are contained within the cavities of the insulation members and when inflated extend outward for pressing against the sidewalls of the refrigerated cargo trailer providing an airtight seal thereagainst and which creates two separate compartments or sections within the cargo trailer—one compartment for the frozen product and the other compartment for the non-frozen product. A length of double-sided tape is attached to the long exposed side of each airbag so that the air bags adhere to the interior sidewalls when they are inflated and so that a firm and reliable airtight seal is also created as a result of the inflation process. A cord attached at its opposed ends to one side of each insulation member is used to pull the bulkhead into position after it has been properly measured and cut to fit within the interior of the refrigerated cargo trailer.

A measuring device is included with the bulkhead to measure and cut the bulkhead to the size appropriate to fit snugly and securely, and in an airtight manner, within the interior of the refrigerated cargo trailer and against the interior sidewalls of the refrigerated cargo trailer. The measuring device includes an extensible pole and locking collar for vertically adjusting the measuring device to determine the height from floor to ceiling of the interior of the refrigerated compartment, and attached to the pole is a plastic board that can be laid against the insulation members and used as a template and straight edge for cutting one or both of the insulation members to the proper size or dimensions. The upper end of the pole also includes a receptacle for receiving therein a marker that is used to mark the locations on the ceiling where the upper side of the bulkhead contacts and butts against.

It is an objective of the present invention to provide a temporary bulkhead for refrigerated structures that allows shippers to transport refrigerated goods and non-refrigerated goods at the same time and in the same structure.

It is another objective of the present invention to provide a temporary bulkhead that saves time in set-up and creates a better bulkhead than currently utilized methods.

It is still another objective of the present invention to provide a temporary bulkhead for refrigerated structures that includes a measuring device for cutting the bulkhead to the appropriate size to sealingly fit within the corresponding interior walls, roof, and floor of the given refrigerated structure.

It is yet another objective of the present invention to provide a temporary bulkhead for refrigerated structures that makes transport more profitable by maintaining the integrity of both the refrigerated goods and non-refrigerated goods stored therein for allowing frozen and non-frozen product to be shipped within the same cargo trailer.

It is still yet another objective of the present invention to provide a temporary bulkhead for refrigerated structures that provides for the more efficient storage and transport dry and frozen freight, reduces liability and man hours, and reduces fuel costs involved in the transport of such goods.

It is yet still another objective of the present invention to provide a temporary bulkhead for refrigerated structures that is easy to use, disposable, lightweight, space saving and affordable to small-scale shippers and vendors.

Still another objective of the present invention is to provide a temporary bulkhead for refrigerated structures that prevents cold air from being transferred to the dry product thereby preventing product from being frozen when it shouldn't or thawed when it shouldn't.

Still yet another objective of the present invention is to provide a temporary bulkhead for refrigerated structures that reduces the risk of injury to the person installing the bulkhead due to the lightweight composition of the bulkhead and the ease of installation of the bulkhead.

Still yet a further objective of the present invention is to provide a temporary bulkhead for refrigerated structures wherein the bulkhead can be removed from the interior of the refrigerated structure such a the trailer of a tractor trailer within a very short time with little effort and then disposed of or discarded.

Yet another objective of the present invention is to provide a temporary bulkhead for refrigerated structures that can be constructed to fit any size of refrigerated structure such as the interior of a refrigerated trailer, container, or unit for a tractor-trailer or a railroad car.

Yet still another objective of the present invention is to provide a temporary bulkhead that can be installed within the interior compartment of the refrigerated structure in about 10 minutes thereby reducing the amount of time the refrigerated structure must tie up the dock, pier, bay, or unloading area and consequently increasing the number of trucks, containers, railroad cars, etc., that can be loaded per day.

Yet still a further objective of the present invention is to provide a temporary bulkhead that can be used by food manufacturers, food distributors, meat processors, dairy processors, produce shippers, etc,.

A further objective of the present invention is to provide a temporary bulkhead that isn't heavy, expensive, complicated to use, and is not an integral part of the refrigerated structure that thereby limits what can be loaded and where the goods can be sent.

These and other objects, features, and advantages will become apparent to those skilled in the art upon a perusal of the following detailed description read in conjunction with the accompanying drawing figures and appended claims.

BRIEF DESCRIPTION OF THE DRAWING FIGURES

Figure 7:
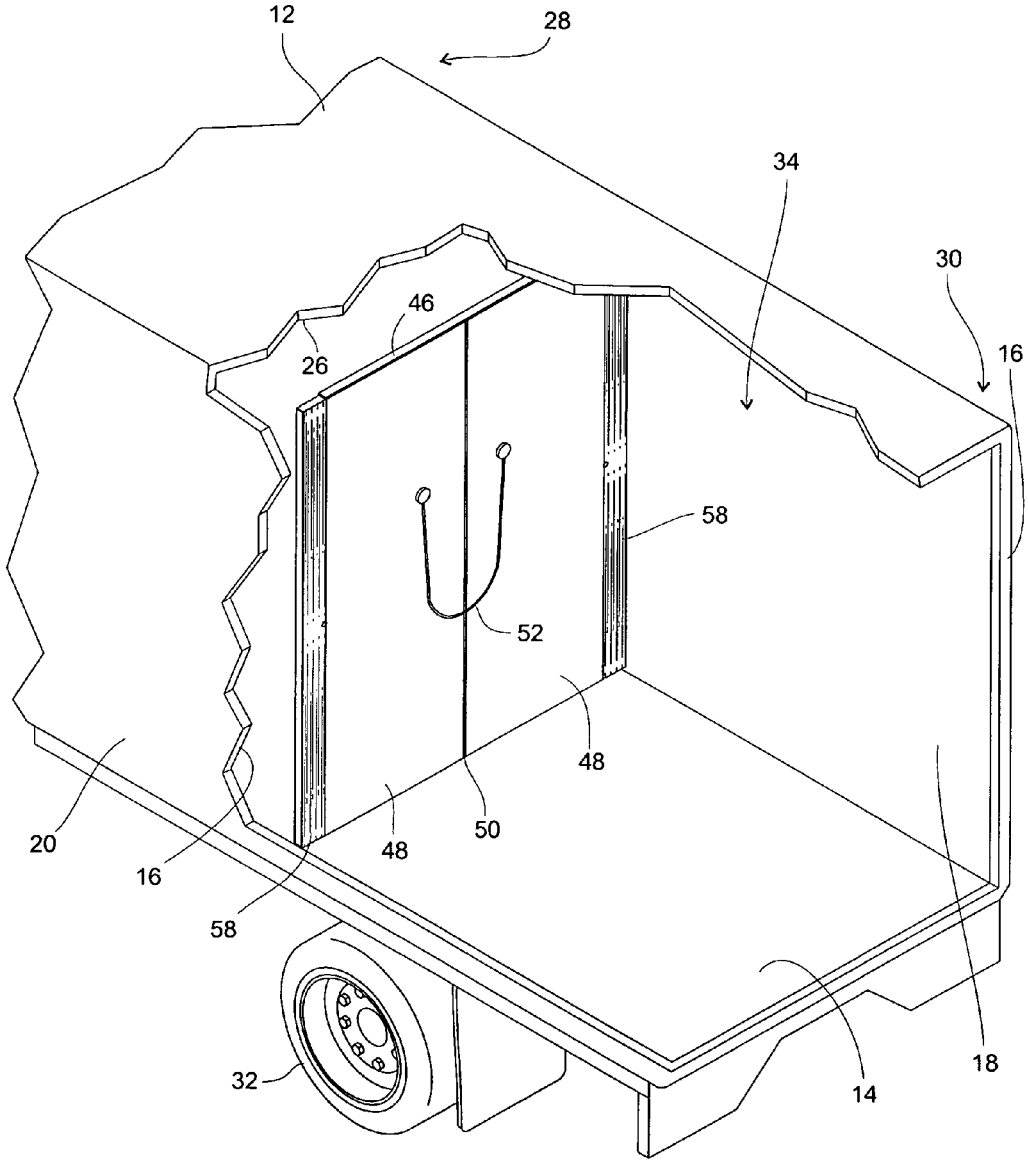
Figure 8:
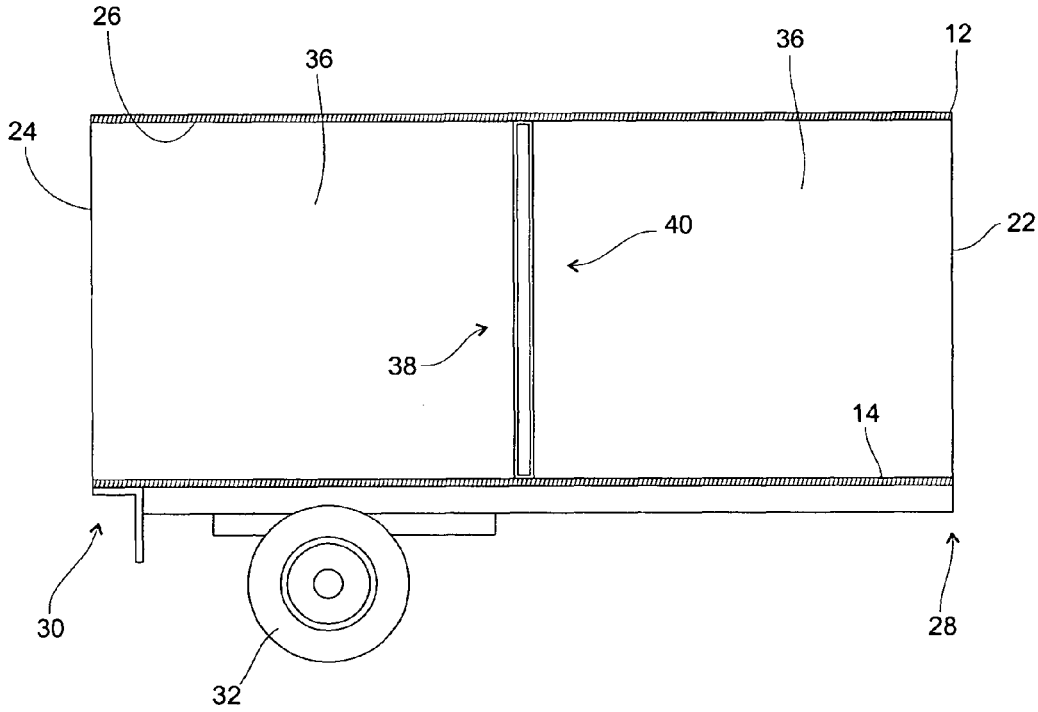

FIG. 7 is a perspective view of the temporary, lightweight, portable, and disposable bulkhead of the present invention illustrating the complete disposition of the temporary, lightweight, portable, and disposable bulkhead of the present invention within the interior compartment of the refrigerated structure such as the trailer of a tractor trailer truck; and FIG. 8 is a side elevational view of the temporary, lightweight, portable, and disposable bulkhead of the present invention illustrating the disposition of the bulkhead within the interior compartment of the refrigerated structure thereby separating the frozen product from the non-frozen product and keeping the frozen product frozen and the non-frozen product from freezing.

DETAILED DESCRIPTION OF THE PREFERRED EMBODIMENT

Illustrated in FIGS. 1-8 is a barrier or bulkhead 10 for disposition within any type of refrigerated structure used in the trucking, railroad, ship, or airline industries, with refrigerated structures including both mobile and stationary refrigeration containers, units, and trailers. The bulkhead 10 is easy to set up, install, and easy to remove and discard, as is used for separating non-frozen foods, items, goods and product (hereinafter product) from frozen foods, items, goods, and product thereby maintaining the integrity of the frozen product and the non-frozen product by keeping the frozen product frozen and the non-frozen product from freezing. The product can obviously include items ranging from food and beverage items to pharmaceuticals and medical supplies at least some of which must be frozen throughout their transit. For representative purposes the lightweight, disposable, temporary bulkhead 10 of the present invention is shown as being used in conjunction with a refrigerated cargo trailer 12 that comprises the cargo carrying unit of a tractor-trailer (the truck for the tractor-trailer isn't shown as the term 'tractor-trailer' encompasses the term and physical object 'truck').

Thus, as shown in FIGS. 4 and 6-8, the refrigerated cargo trailer 12 includes a floor 14, a pair of sidewalls 16 having an interior surface or side 18 and an exterior side 20, a front wall 22, rear doors 24, and a ceiling 26. The refrigerated cargo trailer 12 is further defined by a front 28 and a rear 30 and two pairs of rear wheels 32 with the ceiling 26, the sidewalls 16, the front wall 22, the floor 14 and the rear doors 24 defining an interior storage area 34 that can be divided into at least two storage compartments, sections, or partitions 36. Generally frozen product is located toward the front 28 of the cargo trailer 12 where the refrigeration unit (not shown) is mounted, and non-frozen product is located toward the rear 30. One common vertical dimension from floor 14 to ceiling 26 defining the interior storage area 34 of the cargo trailer 12 is 120 inches (10 feet).

Thus, illustrated in FIGS. 1-8 is the lightweight, temporary, disposable bulkhead 10 of the present invention for creating at least two sections or partitions 36 within the cargo trailer 12 that are sealed and airtight from each other so that one compartment 36 can contain the non-frozen product and the other compartment 36 can contain the frozen product. The bulkhead 10 includes a first side 38 and a second side 40, a lower horizontal side 42 and an upper horizontal side 44 with an insulation strip 46 extending along and coextensive with the upper horizontal side 44. One preferred dimension or configuration for the bulkhead 10 includes a width of at least 43 inches and vertical height from the lower side 42 to the upper side 44 of 120 inches.

Figure 5:
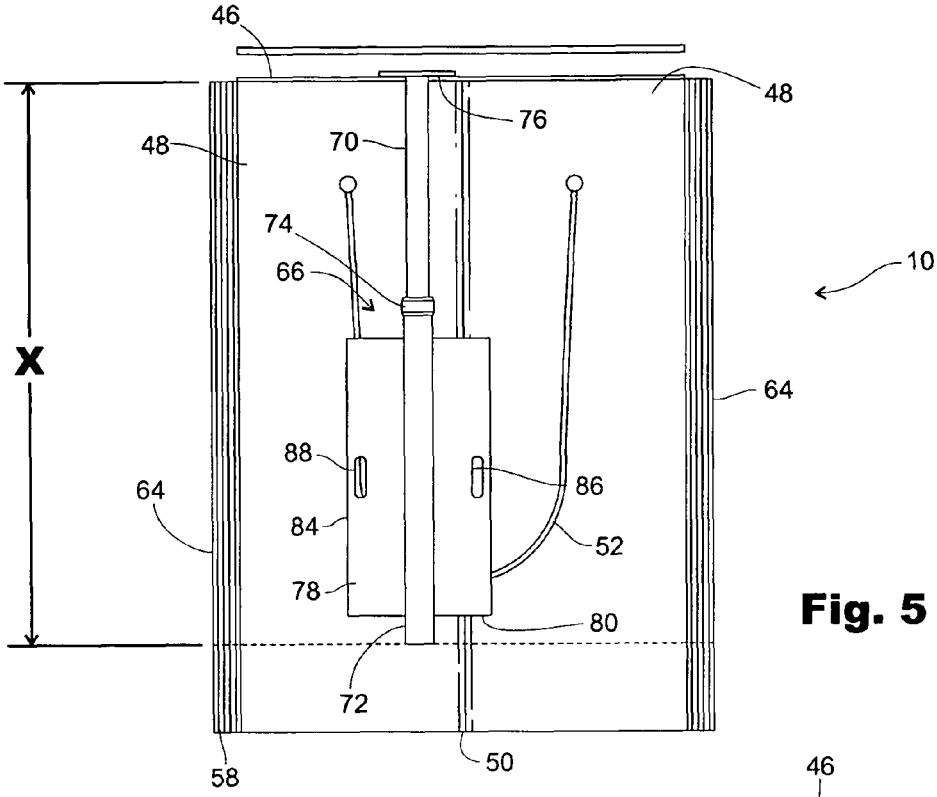
FIG. 5 is a side elevational view of the temporary, lightweight, portable, and disposable bulkhead of the present invention showing the disposition of the measuring device against the bulkhead for cutting the bulkhead to fit within the interior compartment of the refrigerated structure.
Figure 6:
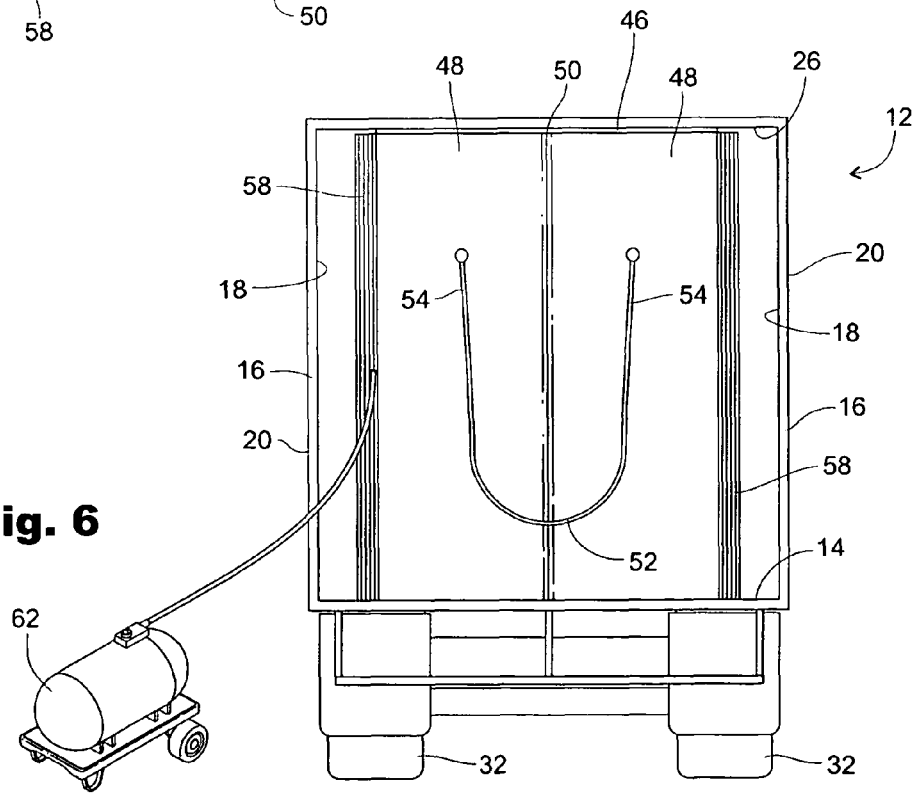
FIG. 6 is a front elevational view of the temporary, lightweight, portable, and disposable bulkhead of the present invention illustrating the inflation of the air bags for pushing against the interior walls of the refrigerated structure for creating an airtight seal.

As shown in FIGS. 1, 2, and 5-7, the bulkhead 10 is composed of a two-piece Styrofoam divider wall at least 2 inches thick or, more particularly, a pair of insulation members 48 pivotally attached to each other along their vertically extending midpoint. The preferred pivotal attachment means for the bulkhead 10 is a vinyl hinge 50 extending along the centerline of the bulkhead 10 and that both divides and interconnects the insulation members 48 from the lower side 42 of the bulkhead 10 to the upper side 44. Prior to disposition within the interior storage area 34 the insulation members 48 are folded together and stored on the floor 14 of the interior storage area 34. Located on the first side 38 of the bulkhead 10 is a cord 52 that is used to lift and raise the bulkhead 10 into position within the interior storage area 34 of the cargo trailer 12. The cord 52 has opposed distal ends 54, and each distal end 54 is attached to each insulation member 48. Each insulation member 48 includes an internal cavity 56, and disposed within each cavity 56 is an air bag 58. The cavity 56 of each insulation member 48 opens along each long vertical side of the bulkhead 10. Each air bag 58 is of a flexible, accordion pleated-type structure that can be selectively inflated and deflated via an air valve 60 mounted to each air bag 58. When the air bags 58 are inflated they extend out of their respective cavities 56 coextensive with the vertical sides of the bulkhead 10. FIG. 6 illustrates a portable air compressor 62 that can be used to inflate each air bag 58 so that the air bags 58 contact the interior surfaces 18 of the sidewalls 16 of the cargo trailer 12 and make an airtight seal thereagainst. A double-sided tape strip 64 is attached to the long exposed external side of each air bag 58 so that when the air bags 58 are inflated for abutting the sidewalls 16 of the interior storage area 34 the double-sided tape strip 64 secures the air bags 58 in a sealed airtight relationship to the sidewalls 16.

Figure 1:
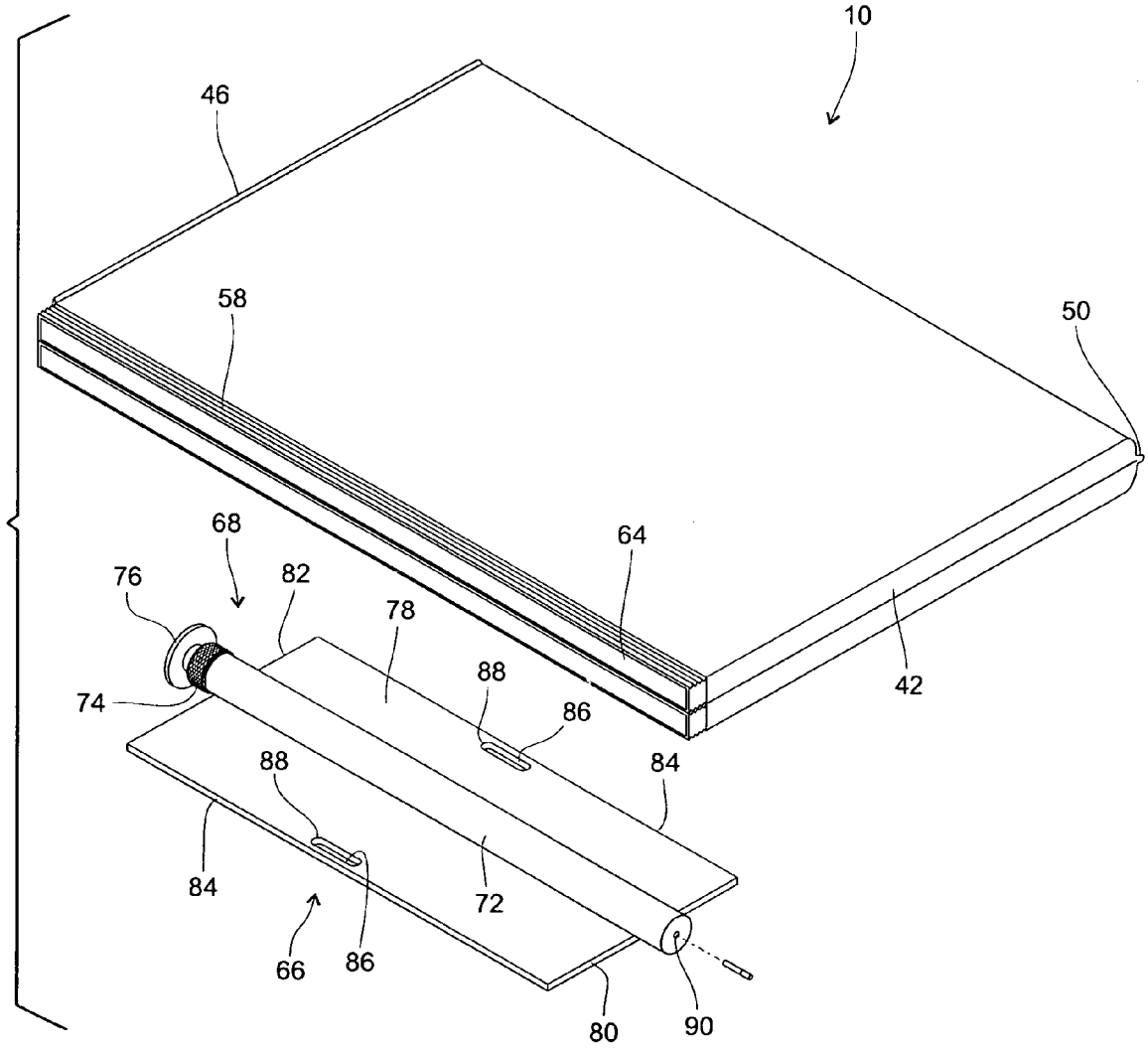
FIG. 1 is a perspective view of the temporary, portable, lightweight, and disposable bulkhead of the present invention illustrating the bulkhead in its folded disposition and also the measuring device used to measure the interior space so that the bulkhead can be cut to size to fit within the interior compartment of the refrigerated structure.
Figure 2:
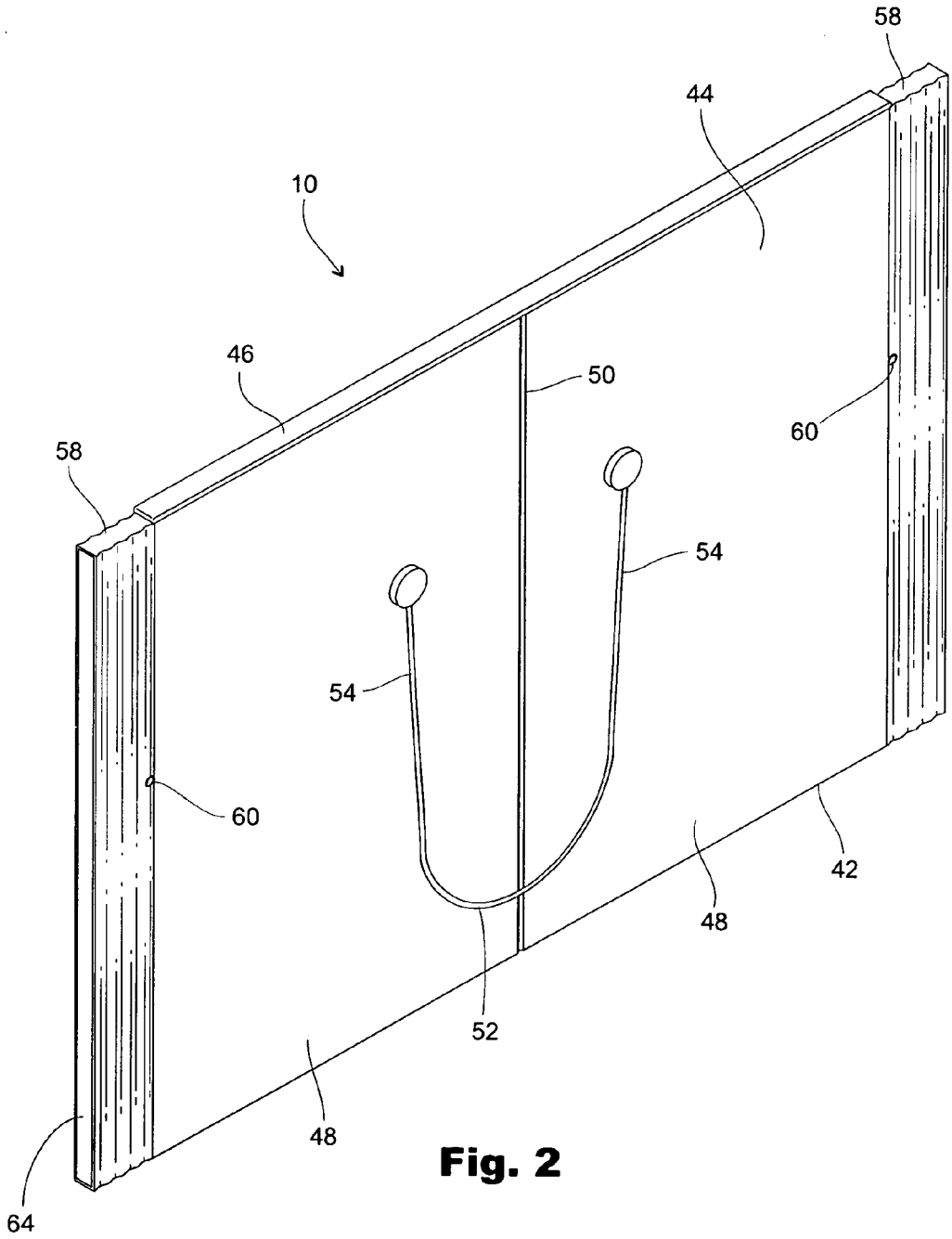
FIG. 2 is a perspective view of the temporary, lightweight, portable, and disposable bulkhead of the present invention illustrating the bulkhead in its unfolded disposition.
Figure 3:
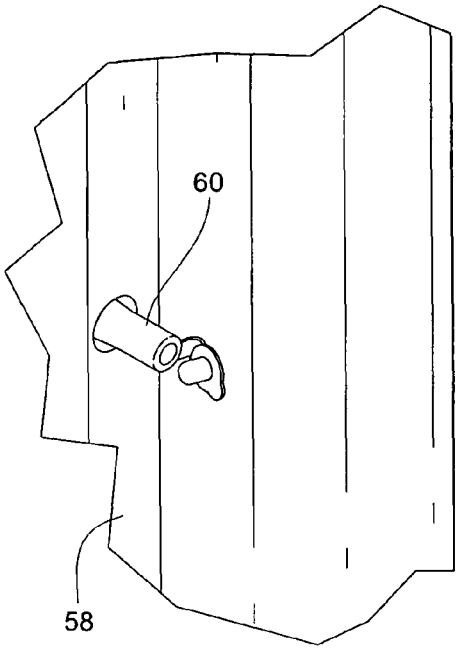
FIG. 3 is an enlarged sectioned view of the temporary, lightweight, portable, and disposable bulkhead of the present invention showing the air valve on one of the two air bags that comprise the bulkhead.
Figure 4:
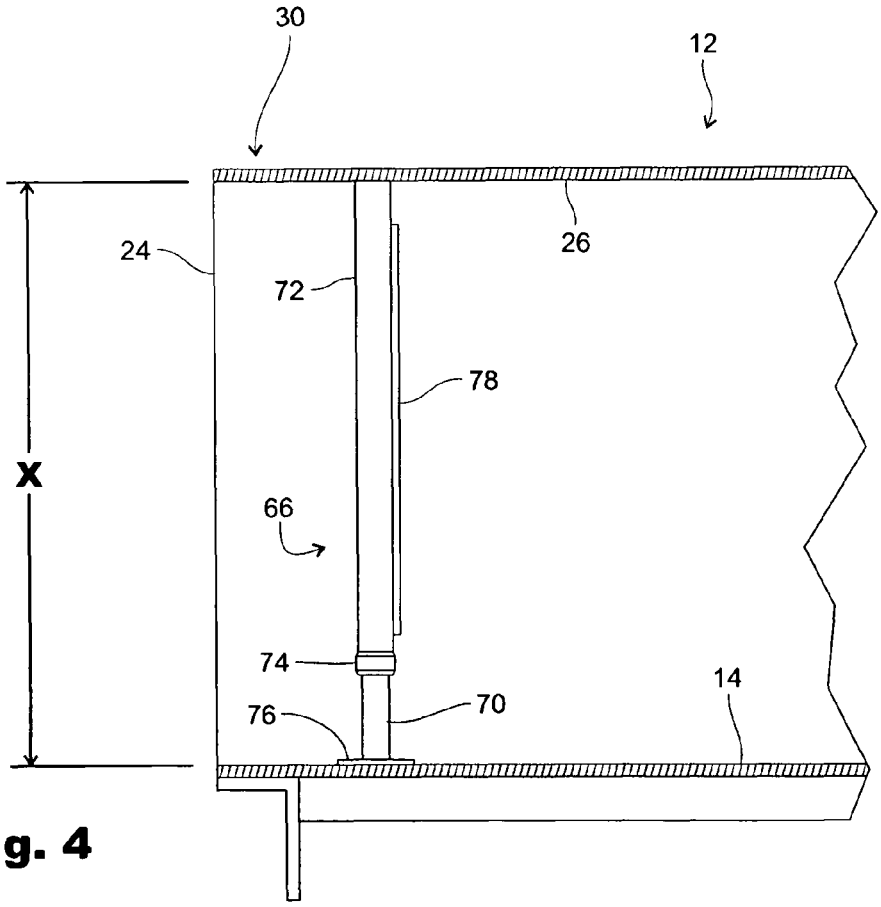
FIG. 4 is a side elevational view of the temporary, lightweight, portable, and disposable bulkhead of the present invention showing the extension of the measuring device within the interior compartment of the refrigerated structure.

Illustrated in FIGS. 1, 5, and 7 is a measuring device 66 for measuring the dimensions—height and width—of the interior storage area 34 of the cargo trailer 12. The measuring device 66 includes an extensible and retractable support pole 68. FIG. 1 shows the support pole 68 in its completely retracted position and FIG. 4 illustrates the support pole 68 in its extended state for accurately measuring the height of the interior storage area 34 from the floor 14 to the ceiling 26. The support pole 68 includes a primary member 70 and an extensible and retractable secondary member 72 with a rotatable securing collar 74 mounted to the lowermost end of the secondary member 72 and which is rotated in one direction for allowing the extension or retraction of the secondary member 72 relative to the primary member 70. Once the support pole 68 has been adjusted for accurately measuring the height of the interior storage area 34, the securing collar 74 is rotated in the opposite direction for tightening the secondary member 72 against the primary member 70 and thereby fixing the extension of the entire support pole 68. The support pole 68 adjusts from five feet three inches to a fully extended height of nine feet nine inches. The support pole 68 includes a base disc 76 that rests upon the floor 14 of the interior storage area 34 for stably supporting the pole 68 in its full extension. Attached to the support pole 68, and more particularly to the secondary member 72, is a plastic board 78 that is preferably five feet wide. The plastic board 78 moves with the extension and retraction of the secondary member 72 relative to the primary member 70. The plastic board 78 includes an upper edge 80, an opposite lower edge 82, and opposed side edges 84 with an aperture 86 formed adjacent each side edge 84 that creates a handle 88 so that the trucker can grip and manipulate the board 78 and the measuring device 66. A marker storage aperture 90 is located at the upper end of the support pole 68, and more specifically the marker storage aperture 90 is located at the upper end of the secondary member 72. An uncapped marker is placed in the marker storage aperture 90 and is used to mark locations on the ceiling 26 where the bulkhead 10, and specifically the foam insulation strip 46, should abut and make an airtight seal thereagainst.

With reference to FIGS. 1-8 one preferred method of setting up the bulkhead 10 will now be set forth. First, the refrigeration unit for the refrigerated cargo trailer 12 should not be on prior to loading the product—both frozen and non-frozen—thereby limiting the amount of condensation that would form on the ceiling 26 and sidewalls 16 of the cargo trailer 12. Then the product is loaded within the interior storage area 34 with the frozen product toward front 28 and the non-frozen product toward the rear 30, i.e., if the refrigeration unit is located at the front of the cargo trailer 12. The measuring pole 66 is then used to obtain the vertical distance from the floor 14 to the ceiling 26 of the interior storage area 34 by loosening the collar 74, resting the base disc 76 on the floor 14 and then extending the secondary member 72 relative to the primary member 70 upward to the ceiling 26. The collar 74 should then be tightened so that the support pole 68 is secure and stable for taking the measurement. The bulkhead 10 is then placed on the floor 14 with the foam insulation strip 46 toward the front 28 of the cargo trailer 12 with the bulkhead 10 folded so that the hinged center 50 is toward the sidewall 16 denoted the left sidewall and both airbags 58 are facing the sidewall 16 denoted the right sidewall. Then the base disc 76 is placed against the foam insulation strip 46 and several marks with a marker are made across the insulation member 48 for making an even cut across the insulation member 48.

Then the collar 74 should be loosened so that the support pole 68 can be reduced to the minimum size, i.e. the secondary member 72 being fully retracted within the primary member 70. The airbag 58 is then pulled away from the bulkhead 10 to the cutting point, the cutting marks, and using the straight edge of the support pole 68, that can be one of the edges 80, 82, or 84 (upper, lower, or opposed sides as circumstances warrant) of the plastic board 78, the bulkhead 10 can then be cut to size with, for example, a box cutter. However, one must be extremely careful to avoid cutting the airbag 58. A marking pen is then placed in the marker storage aperture 90 at the upper end of the secondary member 72 and a series of small marks are made on the ceiling 26 where the product ends. This is where the upper horizontal side 44, that is the insulation strip 46 of the bulkhead 10, is to be positioned and placed. The next step is to remove the backing from both double-sided tape strips 64 attached to the ends of the airbags 58 and then the bulkhead 10 is opened as one would open a book lying flat on the floor 14 of the cargo trailer 12 with the foam insulation strip 46 toward the front 28 of the cargo trailer 12 next to the product. The individual will then grip the cord 52 and pull the bulkhead 10 —both insulation members 48—upward until the upper horizontal side 44, the insulation strip 46, aligns with the marks on the ceiling 26. The individual can then use the side of his foot to position his foot at the lower horizontal side 42 of the bulkhead 10 and gently push the bulkhead 10 from the lower end or bottom in until the bulkhead 10 is perpendicular to both the floor 14 and the ceiling 26. The airbags 58 are then inflated using the portable air compressor 62 to the point that the airbags 58 contact the respective sidewalls 16 along the entire vertical length of the sidewalls 16 from the floor 14 to the ceiling 26 so that the double-sided tape strips 64 contact the sidewalls 16 for making a firm, secure airtight seal thereagainst. It should be emphasized that the measuring device 66 is used to obtain an accurate sizing so that the bulkhead 10 impinges the ceiling 26 and both sidewalls 16 for making a firm and reliable airtight seal against all surfaces 14, 18, and 26.

While the foregoing invention has been described with reference to a preferred embodiment, it should be understood that numerous other variations, alterations, and modifications can be made to the present invention and will fall within scope and ambit of the claims appended hereto.

We claim:

1. A temporary, disposable, lightweight bulkhead, comprising:

a pair of insulation members pivotably attached to each other and able to fold upon each other for storage and transport;

the insulation members including a first side, a second side, a lower horizontal side and an upper horizontal side;

an insulation strip extending along the upper horizontal side;

a cord having opposed distal ends with one of said distal ends secured to one of said insulation members and the other distal end secured to the other insulation member;

each insulation member including a cavity;

a pair of flexible, inflatable accordion pleated-type air bags with one of said air bags disposed in one of said cavities and the other air bag disposed in the other cavity; and a pair of double-sided tape strips with one of said double-sided tape strips attached to one of said air bags and the other double-sided tape strip attached to the other air bag.

2. The bulkhead of claim 1 further comprising a measuring device that is used to measure, size, and cut the bulkhead.

3. The bulkhead of claim 2 wherein the measuring device includes a support pole with the support pole including a primary member, a secondary member mounted to the primary member for extensible and retractable movement therefrom, and a collar for selectively loosening and tightening the secondary member so that the secondary member can be retracted and extended relative to the primary member and held in position after desired extension and retraction.

4. The bulkhead of claim 3 wherein the support pole includes an upper end having a marker storage aperture formed at the upper end.

5. The bulkhead of claim 4 wherein the measuring device includes a plastic board mounted to the secondary member and which moves concomitant with the extension and retraction of the secondary member.

6. The bulkhead of claim 5 wherein the measuring device includes a base disc mounted to the primary member and which supports the primary member in an upright vertical disposition.

7. A temporary, disposable, lightweight bulkhead for disposition within an interior storage area of a refrigerated structure for separating the non-frozen product from frozen product for maintaining the integrity of both the frozen and non-frozen product, comprising:

a pair of insulation members pivotably attached to each other and able to fold upon each other for storage and transport;

the insulation members including a first side, a second side, a lower horizontal side and an upper horizontal side;

an insulation strip extending along the upper horizontal side;

a cord having opposed distal ends with one of said distal ends secured to one of said insulation members and the other distal end secured to the other insulation member;

each insulation member including a cavity;

a pair of flexible, inflatable accordion pleated-type air bags with one of said air bags disposed in one of said cavities and the other air bag disposed in the other cavity;

a pair of double-sided tape strips with one of said double-sided tape strips attached to one of said air bags and the other double-sided tape strip attached to the other air bag; and whereupon the bulkhead is positioned within the interior storage area of the refrigerated structure so that the bulkhead creates two partitions with the frozen product located in one of said partitions and the non-frozen product located in the other partition and the bulkhead forming an airtight seal between the partitions so that the frozen product stays frozen during transit and the non-frozen product is not frozen during transit.

8. The bulkhead of claim 7 further comprising a measuring device that is used to measure, size, and cut the bulkhead.

9. The bulkhead of claim 8 wherein the measuring device includes a support pole with the support pole including a primary member, a secondary member mounted to the primary member for extensible and retractable movement therefrom, and a collar for selectively loosening and tightening the secondary member so that the secondary member can be retracted and extended relative to the primary member and held in position after desired extension and retraction.

10. The bulkhead of claim 9 wherein the support pole includes an upper end having a marker storage aperture formed at the upper end.

11. The bulkhead of claim 10 wherein the measuring device includes a plastic board mounted to the secondary member and which moves concomitant with the extension and retraction of the secondary member.

12. The bulkhead of claim 11 wherein the measuring device includes a base disc mounted to the primary member and which supports the primary member in an upright vertical disposition.

13. A bulkhead for disposition within a interior storage area of a refrigerated cargo trailer having a floor, a ceiling, and opposed sidewalls for a tractor-trailer for separating non-frozen product from frozen product in order to maintain the integrity of both the frozen and non-frozen product, comprising:

a pair of insulation members pivotably attached to each other and able to fold upon each other for storage and transport;

the insulation members including a first side, a second side, a lower horizontal side and an upper horizontal side;

an insulation strip extending along the upper horizontal side;

a cord having opposed distal ends with one of said distal ends secured to one of said insulation members and the other distal end secured to the other insulation member;

each insulation member including a cavity;

a pair of flexible, inflatable accordion pleated-type air bags with one of said air bags disposed in one of said cavities and the other air bag disposed in the other cavity;

a pair of double-sided tape strips with one of said double-sided tape strips attached to one of said air bags and the other double-sided tape strip attached to the other air bag; and whereupon the bulkhead is positioned within the interior storage area of the refrigerated cargo trailer creating a pair of partitions with one of said partitions for the non-frozen product and the other partition for the frozen product with the lower horizontal side resting upon the floor, the insulation strip contacting the ceiling and inflation of the air bags causing each double-side tape strip to contact a respective one of said sidewalls thereby forming an airtight seal between the partitions so that the frozen product stays frozen and the non-frozen product remains unfrozen during transit.

14. The bulkhead of claim 13 further comprising a measuring device that is used to measure, size and cut the bulkhead to fit within the interior storage area of the refrigerated cargo trailer.

15. The bulkhead of claim 14 wherein the measuring device includes a support pole with the support pole including a primary member, a secondary member mounted to the primary member for selective extensible and retractable adjustable movement therefrom, and a collar for selectively loosening and tightening the secondary member so that the secondary member can be retracted and extended relative to the primary member and can be held in position after the desired extension and retraction.

16. The bulkhead of claim 15 wherein the support pole includes an upper end having a marker storage aperture formed at the upper end and within which a marker can be placed for marking locations on the ceiling where the insulation strip should contact for making a tight seal against the ceiling.

17. The bulkhead of claim 16 wherein the measuring device includes a plastic board mounted to the secondary member and which moves concomitant with the extension and retraction of the secondary member and upon which the bulkhead can be placed for cutting the bulkhead to an appropriate size.

18. The bulkhead of claim 17 wherein the measuring device includes a base disc mounted to the primary member and which supports the support pole in an upright disposition when the support pole is placed within the interior storage area with the base disc resting on the floor so that the secondary member can be extended for measuring a height from floor to ceiling of the interior storage area.

* * * * *